United States Patent [19]

Barthule

[11] 4,059,302

[45] Nov. 22, 1977

[54] METAL CHAIN SLING

[75] Inventor: George Barthule, Wheeling, Ill.

[73] Assignee: Liftex Slings, Inc., Libertyville, Ill.

[21] Appl. No.: 678,227

[22] Filed: Apr. 19, 1976

[51] Int. Cl.[2] ..... B66C 1/18

[52] U.S. Cl. ..... 294/74

[58] Field of Search ..... 294/74, 75, 76, 77, 294/67 EA, 78 R; 245/4; 24/230.5 CS, 265 AL, 230.5 S, 230.5 TH, 230.5 V

[56] References Cited

U.S. PATENT DOCUMENTS

| | | | |
|---|---|---|---|
| 1,031,632 | 7/1912 | Doppenschmitt | 245/4 |
| 2,603,523 | 7/1952 | Cameron | 294/74 |
| 3,360,293 | 12/1967 | Barthule | 294/74 |
| 3,868,137 | 2/1975 | Friend | 294/74 |
| 3,870,256 | 3/1975 | Mazzella et al. | 294/77 |
| 3,992,048 | 11/1976 | Berzenye | 294/74 |

FOREIGN PATENT DOCUMENTS

| | | | |
|---|---|---|---|
| 1,446,406 | 6/1966 | France | 294/74 |

*Primary Examiner*—James B. Marbert

*Attorney, Agent, or Firm*—Merriam, Marshall, Shapiro & Klose

[57] ABSTRACT

A sling comprising a plurality of metal chains placed in side-by-side parallel arrangement, a metal terminal at each end of the sling, with both the ends of at least some of the chain lengths being connected thereto, the metal chains being positioned with the links in a plurality of rows lateral to the length of the sling, and a flexible metal cable threaded in a serpentine manner through the center of all the links in a plurality of adjoining rows for most of the length of the sling.

12 Claims, 10 Drawing Figures

FIG. 8
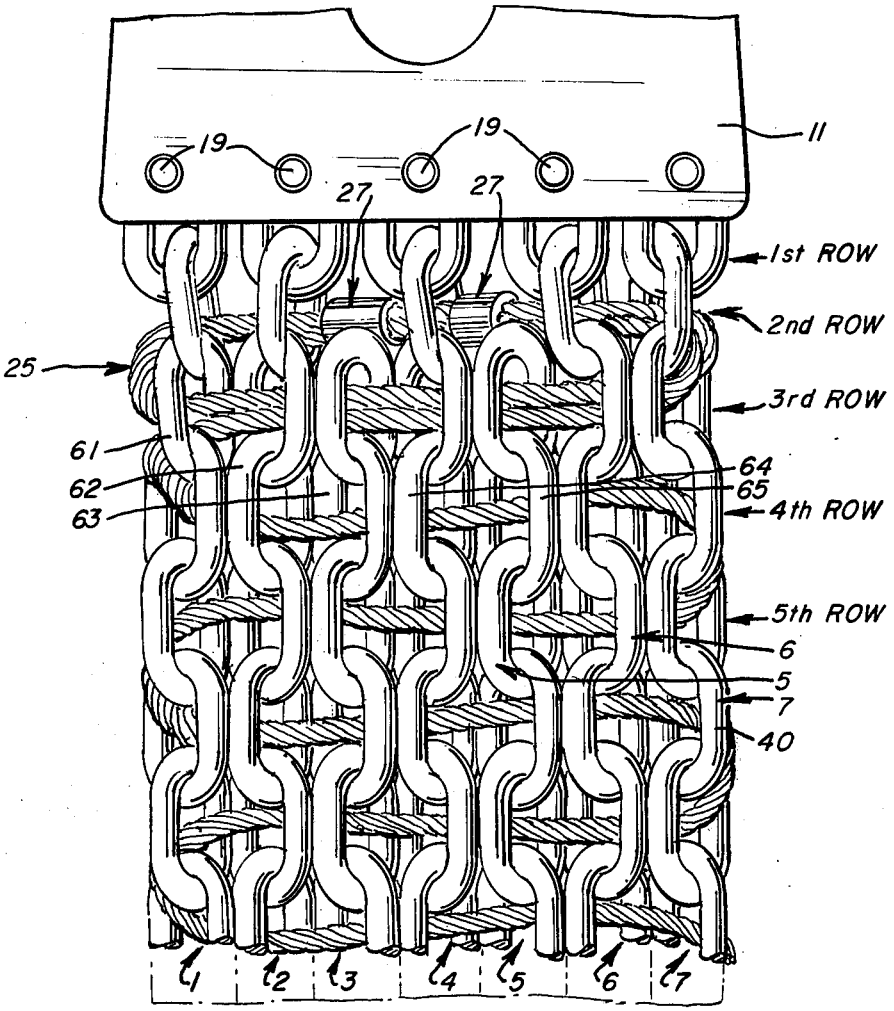
FIG. 9
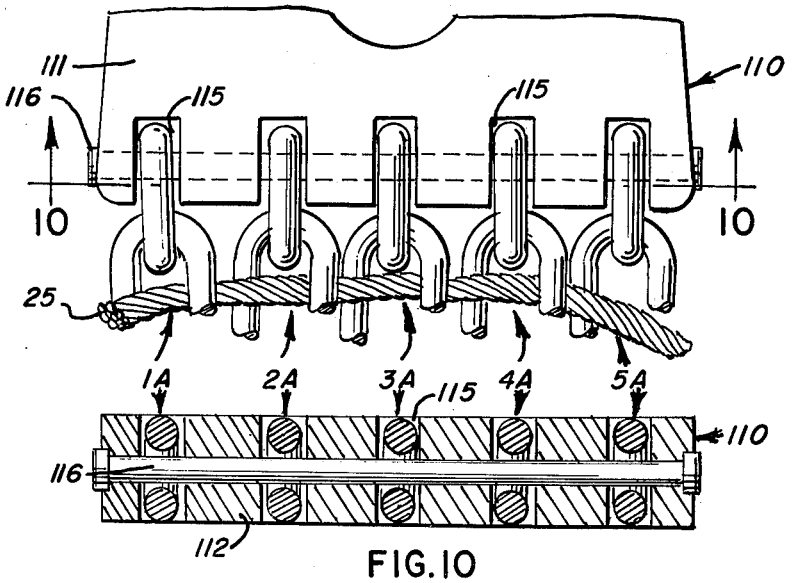
FIG. 10

METAL CHAIN SLING

This invention relates to apparatus and equipment for lifting loads. More particularly, this invention is concerned with an improved sling for lifting loads.

Slings have been used for a long time to lift loads. Slings, generally, have an elongated, flexible body portion which terminates at each end in a terminal by which the sling can be readily grabbed, such as by a lifting hook. U.S. Pat. Nos. 1,931,808 and 2,903,291 show two types of slings which are suitable for many purposes. The particular type and composition of sling which is used will often depend on the goods to be lifted and moved. Often, it is desirable to use a fabric sling to avoid scratching or marring the goods being handled. In many instances, however, it is unnecessary to take undue care in lifting various materials, either because they are hard or not easily scratched or marred, or because some slight marring or scratching is insignificant to the overall object in moving the goods. For such purposes, a metal sling can be used. However, it should be relatively inexpensive, rugged, strong and maintain its strength free of undue care.

My U.S. Pat. No. 3,360,293 discloses a sling comprising a plurality of metal chain lengths of twisted links placed in side-by-side parallel and planar arrangement having a metal terminal at each end to which the ends of the chain lengths are connected, and a plurality of connecting means joining adjacent chain lengths together. The connecting means joining adjacent chain lengths together can be welds, clips or links. While spaced apart welds were considered the most feasible way to join the links, experience showed this to be an expensive procedure. The use of clips and links also involved expensive fabricating steps and were thus undersirable from a cost viewpoint.

There is available on the market another form of sling made from chains using regular links which are perpendicular to adjoining links. This metal sling has side-by-side chains arranged planar with every other lateral row of links having the links vertical and with the links horizontal in the inbetween rows. A metal cable is threaded back and forth through only the links in the vertical rows for the length of the sling. Spacers of short tubular shape, through which the cable passes, are required between each pair of vertical links to keep the chains in proper alignment. Also, since the cable skips the horizontal link rows, it forms a large loop on the sling edges which are exposed to wear, snagging and cutting.

According to the present invention there is provided an improved metal sling comprising a plurality of metal chains placed in side-by-side parallel arrangement, a metal terminal at each end of the sling, with both the ends of at least some of the chains being connected to the terminals, the metal chains being positioned with the links in a plurality of rows lateral to the length of the sling, and a flexible metal cable threaded in a serpentine manner through the center of all the links in a plurality of adjoining rows for a substantial part of the length of the sling.

The sling is advisably constructed of metal chain lengths in which each link in each chain length is substantially identical and is in a plane which is normal to, or at about 90° from, the plane of the adjacent or adjoining links at each end of the link. However, the so-called twisted link chains may also be used in the slings provided by this invention.

When the sling is made from chain lengths in which the links are positioned at about 90° with respect to adjoining links, this relationship between adjoining links is desirably maintained in the sling. Twisting of chain lengths is advisably avoided, except when needed to join the chains to the terminals as will be described later herein.

The flexible metal cable used in the sling is most suitably threaded in a serpentine manner through the center of all the links in a row, such as an odd-numbered row, of the sling, then looped back and threaded through the center of all the links in the adjoining row, e.g. even-numbered row, then looped back and threaded through the center of all the links in the adjoining next highest odd-numbered row, then looped back and threaded through the center of all the links in the adjoining next highest even-numbered row, and then looped and threaded back and forth through the adjoining rows of links in the described serpentine manner for a substantial part or most, and desirably all, of the length of the sling.

By threading the flexible metal cable through the adjoining rows of links, in a chain in which the links are about at 90° with respect to adjoining links, the links in each row are caused to tilt to be at about 45° from the theoretical surface of the sling.

The links in every other row, as for example the even-numbered rows, may be positioned at an angle of about 45° from the sling surface while the links in the inbetween rows, e.g. the odd-numbered rows, may be positioned at an angle of about 135° from the sling surface. In this arrangement, all of the links in a row are positioned in planes which are parallel to one another. Furthermore, even though tilted the links in each row are maintained at an angle of approximately 90° with respect to the links in each adjoining row.

The links in each row, besides being positioned so that each two adjacent links in a row are parallel to one another, may be positioned so that each two adjacent links in a row are at an angle of approximately 90° with respect to one another.

It is also suitable in fabricating a sling according to the invention, to have the links in a row positioned in a random order with some adjacent links in parallel planes and other adjacent links in the rows at 90° from each other. Under this arrangement, as well as the others already described, each top and bottom surface or side of the sling has one side length of each link located at the top surface and at the bottom surface. This provides a more uniform sling surface than would be obtained with the links at 90° to, or parallel with, the sling top and bottom surfaces.

The invention will be described further in conjunction with the attached drawings, in which:

FIG. 8 is a plan view of one end of a third embodiment of the sling provided by this invention;

FIG. 9 is a partial plan view of the end of a sling showing an alternative means of connecting the chain ends to a terminal; and FIG. 10 is a sectional view along the line 10—10 of FIG. 9.

So far as is practical, the same elements or parts which appear in the different views of the drawings will be identified by the same numbers.

Figure 1:
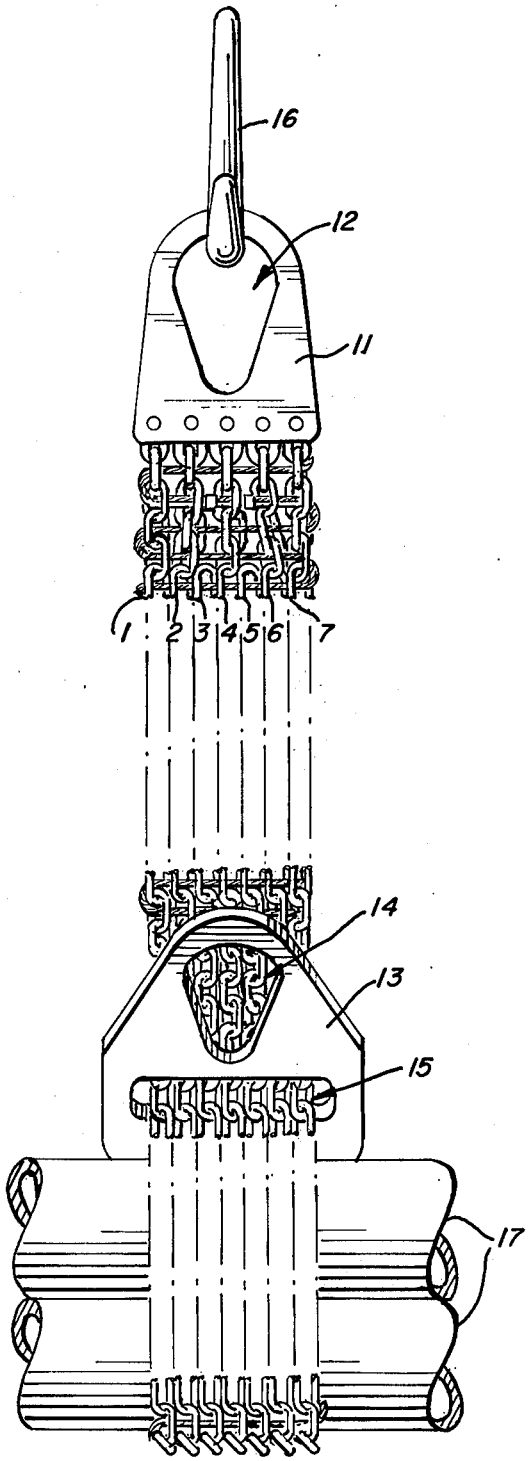
FIG. 1 is a front elevational view of a sling according to the subject invention illustrating its use in a choker hitch and positioned on a hoisting hook.
Figure 2:
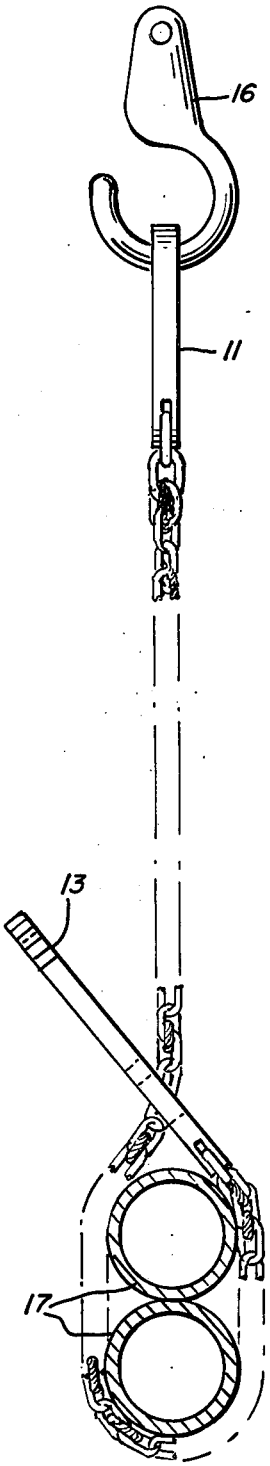
FIG. 2 is a side elevational view of the sling shown in FIG. 1.

With reference to FIGS. 1 and 2, seven chains numbered 1 to 7 are placed in side-by-side parallel arrangement to each other. The chains 1, 2, 4, 6 and 7 are of the same length and the links of each chain are the same size and shape. Each of those five chains is connected at one end to end terminal 11 having a hole or eye 12, and at the other end to terminal 13 having hole or eye 14 and slot 15. The slot 15 is used to form a choker hitch on a load by threading terminal 11 through slot 15. In addition to being used as a choker hitch, the sling can be employed in the form of a simple basket hitch by placing hook 16 through both of eyes 12 and 14 instead of through only eye 12 as shown in the choker hitch of FIGS. 1 and 2. Pipes 17 are shown being lifted by means of the sling used in the form of a choker hitch.

Figure 3:
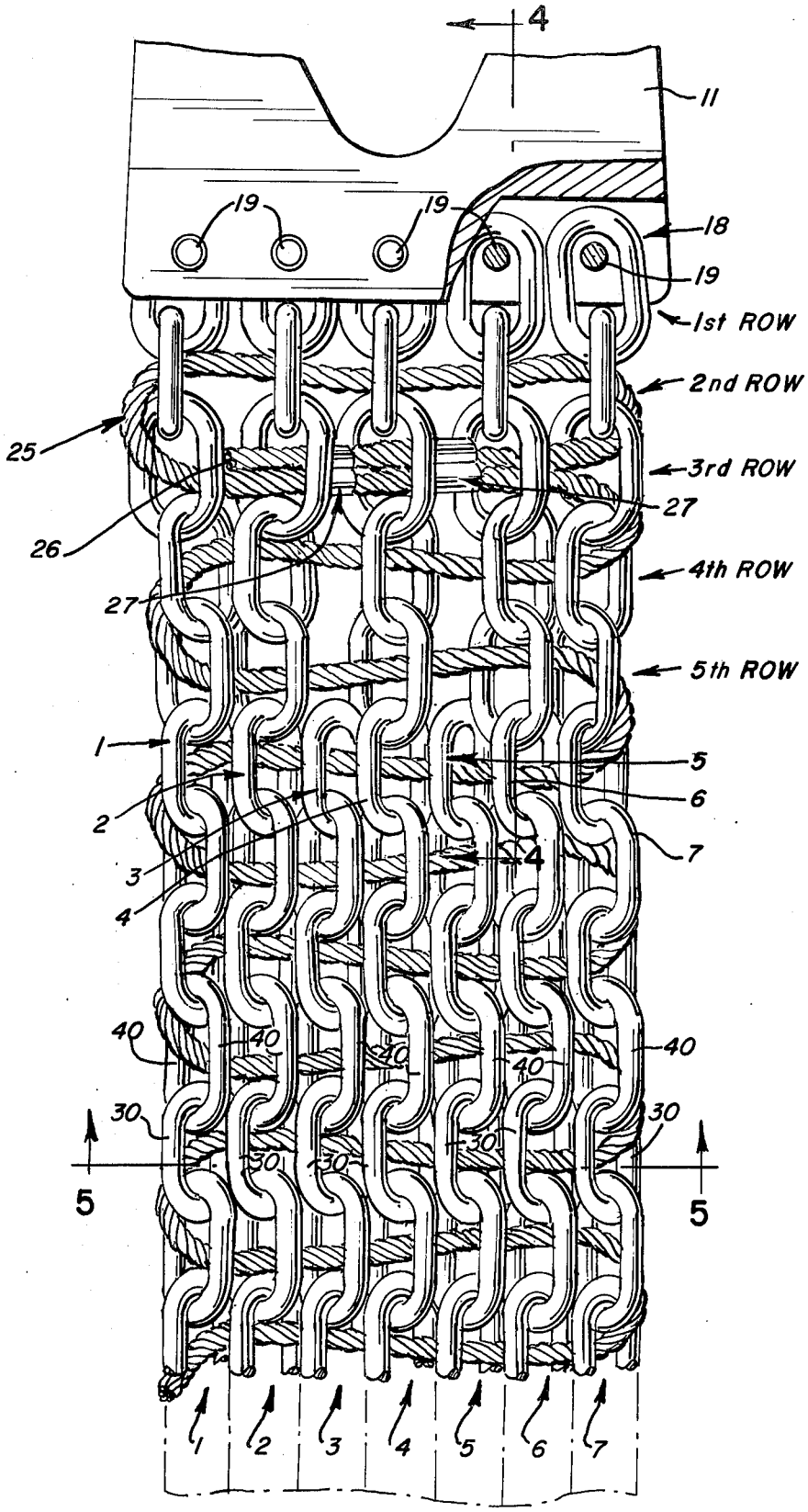
FIG. 3 is a partial plan view of one end of the sling shown in FIGS. 1 and 2.
Figure 4:
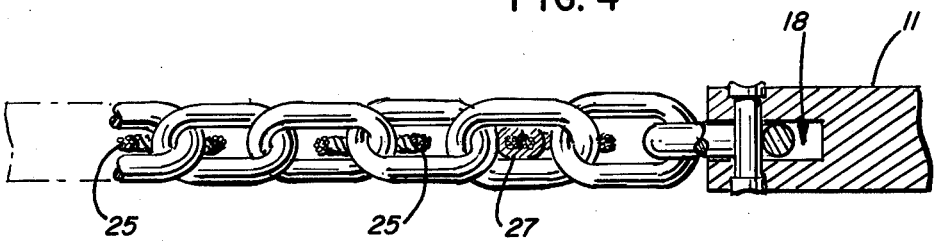
FIG. 4 is a sectional view on the line 4—4 of FIG. 3.
Figure 6:
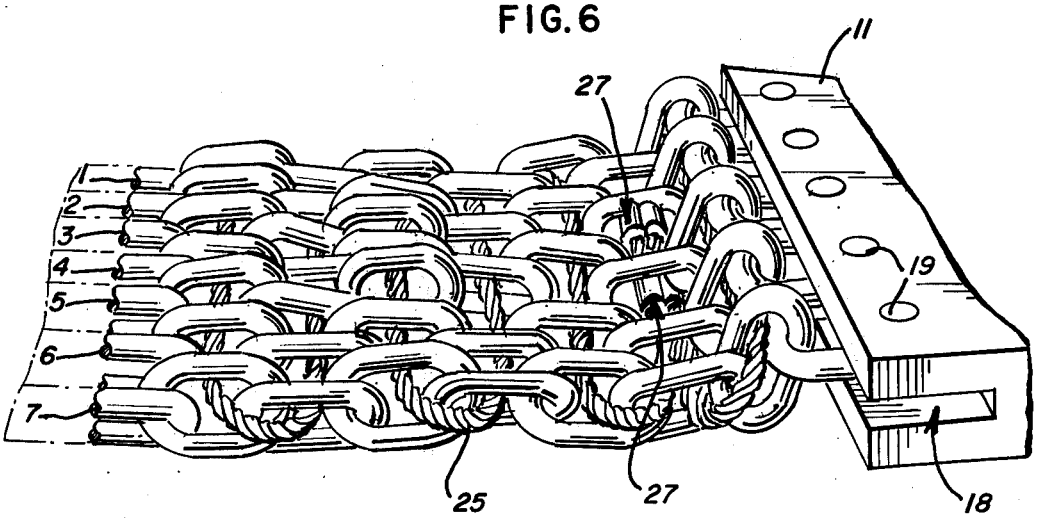
FIG. 6 is a perspective view of the end portion of the sling shown in FIGS. 1 to 3.

As shown in FIGS. 3, 4 and 6, the terminal 11 has a groove 18 in its inner end. The groove 18 is slightly wider than the thickness of the chain links so that the end links of the chains 1, 2, 4, 6 and 7 can be positioned in the groove in side-by-side arrangement and held in place by pins 19 which extend through the thickness of terminal 11 and through the links. The end links at the other end of chain lengths 1, 2, 4, 6 and 7 are joined to terminal 13 in the same way as the end links are joined to terminal 11.

FIGS. 1, 3 and 6 show the chains 3 and 5. Chain 3 is located between chains 2 and 4, and chain 5 is located between chains 4 and 6. Each of the chains 3 and 5 is shown in the drawings to be five links shorter than the lengths of chains 1, 2, 4, 6 and 7. Furthermore, the chains 3 and 5 are not connected to the sling terminals 11 and 13. The chains 3 and 5 may be considered as dummy chain lengths or fillers as they do not enter into the tensile strength of the sling. They are advisably employed, however, to provide a transition zone so that the end parts of the chains 1, 2, 4, 6 and 7 connected to the sling terminals can be gradually rotated slightly link by link from the normal angles of about 45° and 135° at which they are positioned in the body of the sling to a position where the end most two links in the chains are respectively at angles of about 90° and 180° with respect to the terminals 11 and 13. The use of the dummy chain lengths 3 and 5 permits the chains 1, 2, 4, 6 and 7 to join the sling terminals 11 and 13 more or less in a straight line and with the opposing edges of the sling maintained essentially parallel to one another. In the absence of a dummy chain in the sling it may be necessary for the end part of the sling to flare outwardly to accommodate joining the chains to the terminals, as will be seen in the attached FIG. 7.

As shown in the drawings with particular reference to FIG. 3, a flexible metal cable 25 is threaded back and forth through adjoining rows of links in the chains. The end 26 of cable 25 is positioned in the third row of parallel links and it is then threaded backwardly through the second row of links, back through the third row of links, then looped back through the fourth row of links, then looped back through the fifth row of links and so on for the length of the sling, with the cable being ended in the same way it is started. Cable clips 27, or other frictional connection means, can be used at each end of the sling to hold the two adjoining portions of the metal cable together to prevent it from slipping loose.

Although the cable is shown in FIGS. 1 to 6 threaded through the entire chain length of the sling, under some circumstances it may be advisable to only thread the cable through a portion of the sling length.

Figure 5:
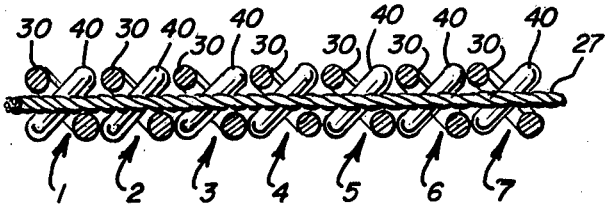
FIG. 5 is a sectional view taken along the line 5—5 of FIG. 3.

With reference to FIGS. 3 and 5, it will be seen that all of the links 30 in a row are at an angle of about 45° from the plane of the sling surface. The next adjacent row of links 40 is seen to be at an angle approximately 135° from the sling surface, using of course the same base line in measuring the angle and rotating from that base line in a clockwise direction. If the angle is determined by a counterclockwise rotation from the base line, then the links 40 would be at an approximately 45° angle whereas the links 30 would be at an angle of approximately 135°.

Although the sling of FIGS. 1 to 6 employs two dummy chains it is within the contemplation of the invention to completely eliminate such dummy chains and to have all of the chains used in the sling joined to the terminals 11 and 13. Furthermore, in the manufacture of some slings, it may be advisable to employ only one dummy chain or any number more than the two dummy chains shown in the embodiment of FIGS. 1 to 6.

The function of the cable 25 which is threaded in a serpentine manner through the adjoining rows of links is to hold the chains in a preset but flexible pattern in a manner which provides substantial flexibility and twisting of the sling. The cable, however, is not intended to provide any tensile strength to the sling.

Because the adjoining rows of links in the sling of FIGS. 1 to 6 are located respectively at 45° and 135° from the plane of the sling surface, a rather smooth textured surface is obtained. Thus, the links are placed in greater surface contact with loads carried by the sling, and thereby obtain greater frictional gripping action, than would be the case if the chains were so positioned as to have adjacent links running parallel to and then perpendicular with the surface of the sling.

Figure 7:
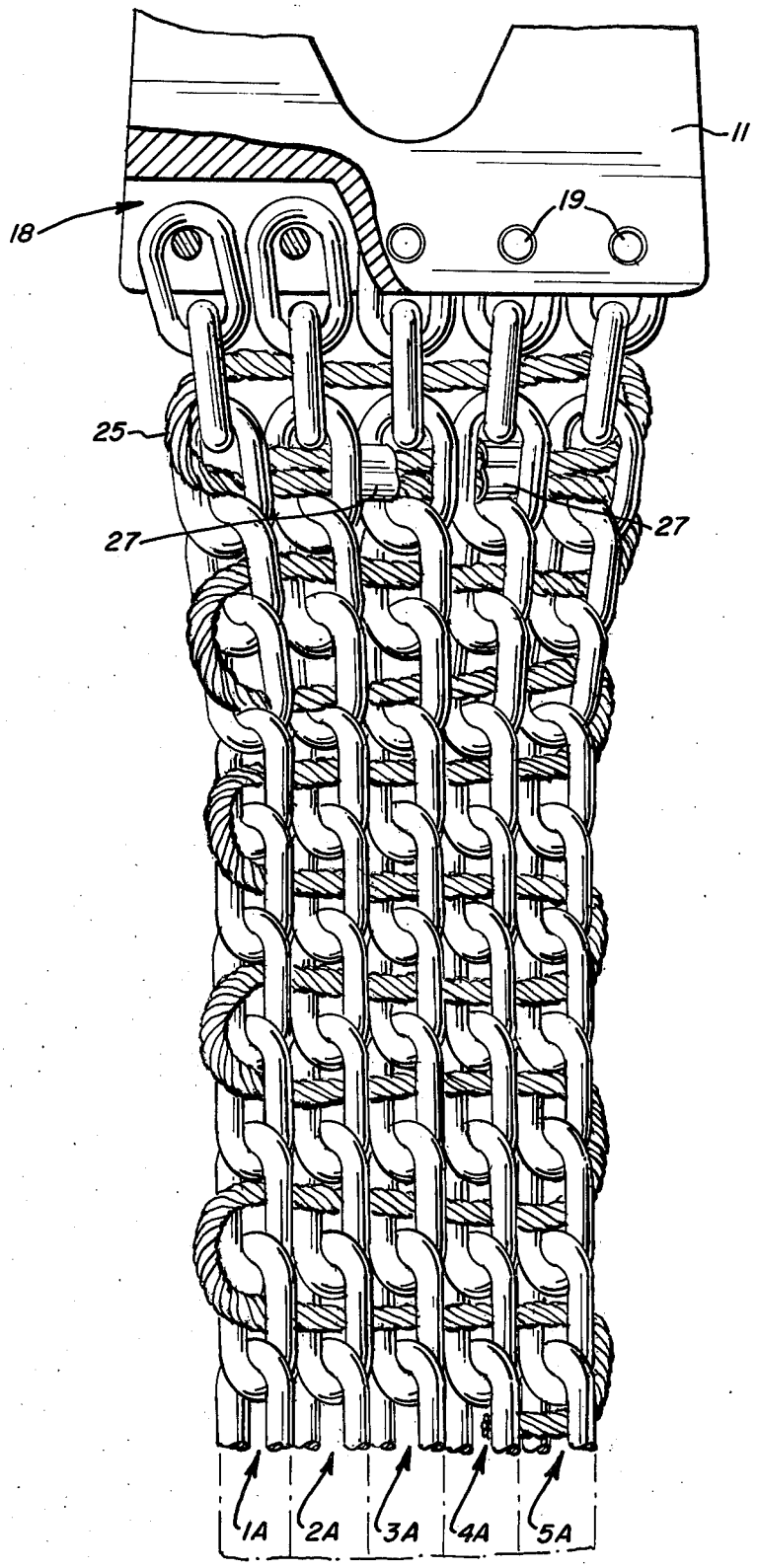
FIG. 7 is an end view of a second embodiment of a sling provided according to the invention.

A second embodiment of the invention is illustrated in FIG. 7. This embodiment is similar to the previous embodiment. The chains 1A, 2A, 3A, 4A and 5A of the sling of FIG. 7 correspond to the chains 1, 2, 4, 6 and 7 shown in the sling of FIG. 3. Thus, the two slings are identical except that the two dummy chains 3 and 5 are not included in the sling embodiment illustrated by FIG. 7. The sling embodiment of FIG. 7, however, requires that the end portion of the sling which joins the terminals 11 and 13 to flare outwardly slightly. This is necessary as the links are rotated in transitional position from the 45°–135° angle through the last four or five links until the adjoining links at each terminal are respectively perpendicular and parallel to the plane of the terminals 11 and 13. Because the effective width of a link parallel to the terminals 11 and 13 acquires a greater width than a link angled at 45° or 135° it is clear that the tapering of the end portion of the chains is necessitated thereby as the chains progress to the terminal.

The third embodiment of sling shown in FIG. 8 is very similar to the sling shown in FIG. 3 except primarily for the positioning of the links in the rows. The links in the rows of the sling shown in FIG. 8 have each two adjacent links in the rows at an angle of approximately 90° with respect to one another. Row 4 is representative. That row in FIG. 8 has the two adjacent links 61 and 62 positioned in planes at approximately 90° with respect to each other. Similarly, the two adjacent links 62 and 63 are at 90° with respect to each other, as are the two links 63 and 64, and the two links 64 and 65 and so on. Thus, every other link in the row is parallel to one another. However, the adjacent links in each chain length are maintained at approximately 90° with respect to one another except where the chains are connected to the terminals.

The sling of FIG. 8 has dummy chains 3 and 5 which are two links shorter at each end than the chains joined to the terminals. The cable 25 is started in the second row of links, looped through the links in the third row, looped back through the second row of links, looped back through the third row, then through the fourth row and so on for advisably the length of the chains. Cable clips 27 frictionally join the two cable bodies together in the second row at each end of the sling.

FIGS. 9 and 10 show an alternative means for joining the end links of each chain length to a terminal. The terminal 110 has spaced apart substantially flat opposing faces 111 and 112 and a plurality of spaced-apart grooves 115 perpendicular to the faces 111 and 112. The grooves are sized to receive the end links of chains 1A, 2A, 3A, 4A and 5A in vertical position. A hole extends the width of terminal 110 and receives pin 116 which extends through each of the end links and the grooves to thereby join the chains to the terminal. A similar arrangement may be provided at both ends of the sling.

The foregoing detailed description has been given for clearness of understanding only, and no unnecessary limitations should be understood therefrom, as modifications will be obvious to those skilled in the art.

What is claimed is:

1. A sling comprising:

a plurality of metal chains placed in side-by-side parallel arrangement, a metal terminal at each end of the sling, with both ends of at least some of the chains being connected thereto, the metal chains being positioned with the links in a plurality of rows lateral to the length of the sling, the links in even-numbered rows being at an angle of approximately 45°, and the links in the odd-numbered rows being at an angle of approximately 135°, from the top bearing surface of the sling, and with the links in each row being at an angle of approximately 90° with respect to the links in each adjoining row, and a flexible metal cable threaded in a serpentine manner through the center of all the links in an odd-numbered row, looped back and threaded through the center of all the links in the adjoining even-numbered row, then looped back and threaded through the center of all the links in the adjoining next highest odd-numbered row, then looped back and threaded through the center of all the links in the adjoining next highest even-numbered row, and then looped and threaded back and forth through the adjoining rows of links in the described serpentine manner for most of the length of the sling.

2. A sling according to claim 1 in which the cable is double ended and each end is fixedly positioned near each terminal.

3. A sling according to claim 2 in which each end of the cable is looped to the rear and threaded into the next prior row of links to put two cable sections in side-by-side position, and friction connection means joining the cable sections together.

4. A sling comprising:

a plurality of metal chains placed in side-by-side parallel arrangement, a metal terminal at each end of the sling, with both ends of at least some of the chains being connected thereto, the metal chains being positioned with the links in a plurality of rows lateral to the length of the sling, each two adjacent links in each row being either parallel to one another or at an angle of approximately 90° with respect to one another, the links in the rows being at an angle of approximately 45°, or at an angle of 135°, from the top bearing surface of the sling, and a flexible metal cable threaded in a serpentine manner through the center of all the links in a plurality of adjoining rows for most of the length of the sling.

5. A sling according to claim 4 in which the links in each chain are at approximately 90° with respect to adjoining links in the chain.

6. A sling according to claim 4 in which the flexible metal cable is threaded in a serpentine manner through the center of all the links in an odd-numbered row, looped back and threaded through the center of all the links in the adjoining even-numbered row, then looped back and threaded through the center of all the links in the adjoining next highest odd-numbered row, then looped back and threaded through the center of all the links in the adjoining next highest even-numbered row, and then looped and threaded back and forth through the adjoining rows of links in the described serpentine manner for most of the length of the sling.

7. A sling comprising:

a plurality of metal chains placed in side-by-side parallel arrangement, a metal terminal at each end of the sling, with both ends of at least some of the chains being connected thereto, the metal chains being positioned with the links in a plurality of rows lateral to the length of the sling, all the links in nearly all of the rows being positioned so that each two links adjacent to one another in each row are at an angle of approximately 90° with respect to one another, the links in the rows being at an angle of approximately 45°, or at an angle of 135°, from the top bearing surface of the sling, and a flexible metal cable threaded in a serpentine manner through the center of all the links in a plurality of adjoining rows for most of the length of the sling.

8. A sling according to claim 7 in which the links in each chain are at approximately 90° with respect to adjoining links in the chain.

9. A sling according to claim 7 in which the flexible metal cable is threaded in a serpentine manner through the center of all the links in an odd-numbered row, looped back and threaded through the center of all the links in the adjoining even-numbered row, then looped back and threaded through the center of the links in the adjoining next highest odd-numbered row, then looped back and threaded through the center of all the links in the adjoining next highest even-numbered row, and then looped and threaded back and forth through the adjoining rows of links in the described serpentine manner for most of the length of the sling.

10. A sling comprising:

a plurality of metal chains placed in side-by-side parallel arrangement, a metal terminal at each end of the sling, with both of the ends of the chain lengths being connected thereto, except for at least one of the chains which is not connected to the terminals, the metal chains being positioned with the links in a plurality of rows lateral to the length of the sling, and a flexible metal cable threaded in a serpentine manner through the center of all the links in a plurality of adjoining rows for most of the length of the sling.

11. A sling comprising:

a plurality of metal chains placed in side-by-side parallel arrangement, a flat metal terminal at each end of the sling, a groove which extends nearly the width of the terminal in the end of each terminal, the end link at each end of at least some of the chain lengths being positioned in the terminal groove and connected thereto by pins passed through the terminals and the end links, the metal chains being positioned with the links in a plurality of rows lateral to the length of the sling, and a flexible metal cable threaded in a serpentine manner through the center of all the links in a plurality of adjoining rows for most of the length of the sling.

12. A sling comprising:

a plurality of metal chains placed in side-by-side parallel arrangement, a metal terminal at each end of the sling, with both of the ends of at least some of the chain lengths being connected thereto, each metal terminal having substantially flat opposing faces, a plurality of spaced-apart grooves in each terminal, a chain end link in each groove and a pin passing through the terminal, grooves and end links to join the chains to the terminal, the metal chains being positioned with the links in a plurality of rows lateral to the length of the sling, and a flexible metal cable threaded in a serpentine manner through the center of all the links in a plurality of adjoining rows for most of the length of the sling.

* * * * *